US005738168A

United States Patent [19]

Patel et al.

[11] Patent Number: 5,738,168

[45] Date of Patent: Apr. 14, 1998

[54] FIN TUBE HEAT EXCHANGER

[75] Inventors: Ramchandra L. Patel, Southgate; Shyr-ing Hu, Bloomfield Hills, both of Mich.

[73] Assignee: Ford Motor Company, Dearborn, Mich.

[21] Appl. No.: 569,545

[22] Filed: Dec. 8, 1995

[51] Int. Cl.[6] ..... F28D 1/04

[52] U.S. Cl. ..... 165/151; 165/181; 165/DIG. 503; 165/DIG. 502

[58] Field of Search ..... 165/151, 181, 165/DIG. 502, DIG. 503

[56] References Cited

U.S. PATENT DOCUMENTS

| | | | |
|---|---|---|---|
| 3,438,433 | 4/1969 | Gunter | 165/151 |
| 4,709,753 | 12/1987 | Reifel | 165/125 |
| 4,723,599 | 2/1988 | Hanson | 165/181 X |
| 4,830,102 | 5/1989 | Bakay et al. | 165/151 |
| 4,832,117 | 5/1989 | Kato et al. | 165/151 |
| 4,860,822 | 8/1989 | Sacks | 165/151 |
| 4,958,681 | 9/1990 | Kadle | 165/151 |
| 5,042,576 | 8/1991 | Broadbent | 165/151 |
| 5,099,914 | 3/1992 | Reifel | 165/151 |
| 5,111,876 | 5/1992 | Nash | 165/151 |

FOREIGN PATENT DOCUMENTS

| | | | |
|---|---|---|---|
| 0319451 | 6/1989 | European Pat. Off. | 165/151 |
| 0223995 | 11/1985 | Japan | 165/151 |
| 0153392 | 7/1986 | Japan | 165/151 |
| 0205794 | 9/1986 | Japan | 165/151 |
| 0272593 | 12/1986 | Japan | 165/151 |
| 63-3185 | 1/1988 | Japan . | |
| 0108195 | 5/1988 | Japan | 165/151 |
| 0116093 | 5/1988 | Japan | 165/151 |
| 63-1833391 | 7/1988 | Japan . | |
| 0208698 | 8/1989 | Japan | 165/151 |
| 0252899 | 10/1989 | Japan | 165/151 |
| 2-29597 | 1/1990 | Japan . | |
| 0037293 | 2/1990 | Japan | 165/151 |
| 0169991 | 6/1990 | Japan | 165/151 |
| 4015493 | 1/1992 | Japan | 165/151 |
| 61-6591 | 1/1996 | Japan . | |

*Primary Examiner*—John Rivell
*Assistant Examiner*—Christopher Atkinson
*Attorney, Agent, or Firm*—Raymond L. Coppiellie, Esq.; Roger L. May, Esq.

[57] ABSTRACT

A conductive fin for a heat exchanger includes an elongated fin member having two rows of tube receiving apertures extending through the fin member. The fin member includes two rows of raised members located on either side of a centerline bisecting the fin member so as to form a series of closely spaced pairs of raised members located between any two tube receiving apertures and being symmetrical about the centerline and defining two openings with one opening being larger than the other. Each of the raised members defines a pair of legs extending from the plane of the fin member and is positioned to channel air into the space between each respective pair of tube receiving apertures so as to increase the coefficient of heat transfer therebetween without increasing air pressure drop across the heat exchanger.

15 Claims, 2 Drawing Sheets

FIG 1
PRIOR ART
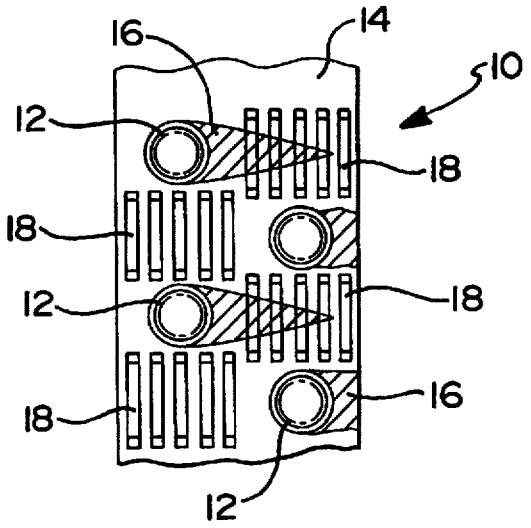
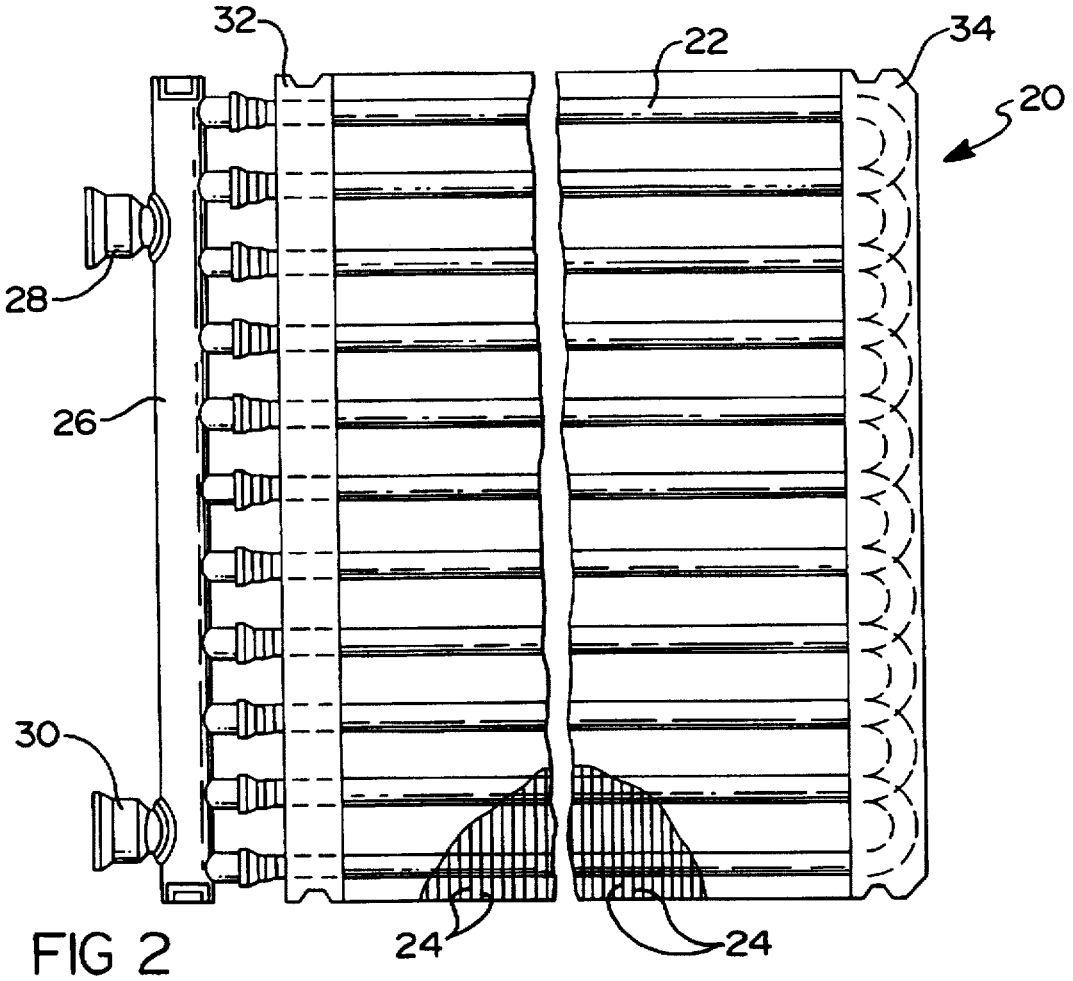
FIG 2

FIG 3
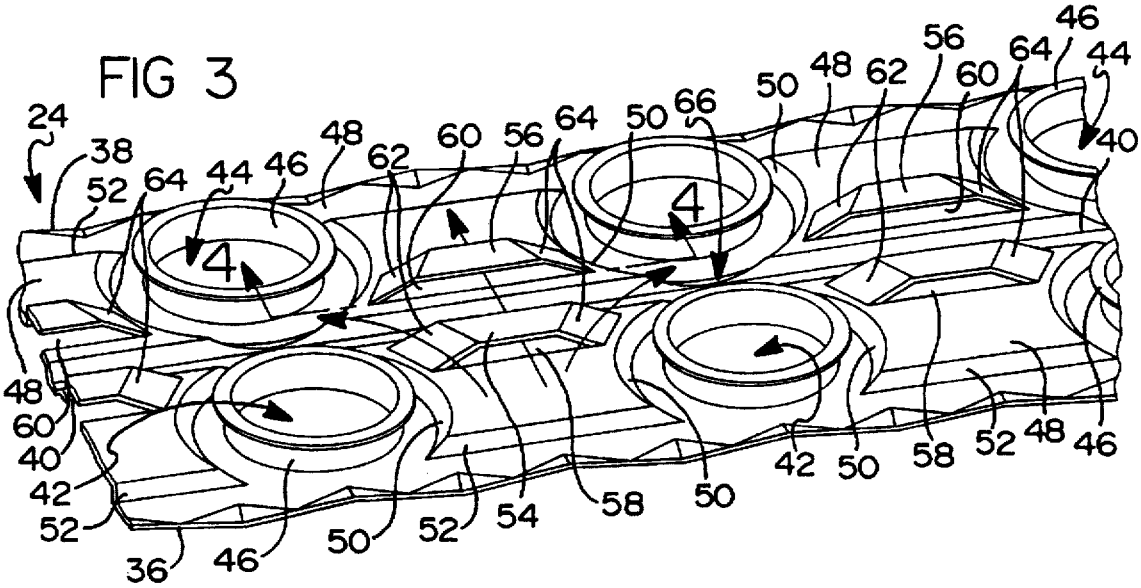
FIG 4
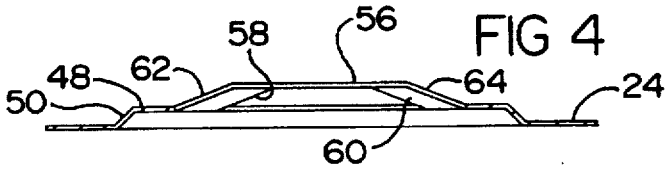
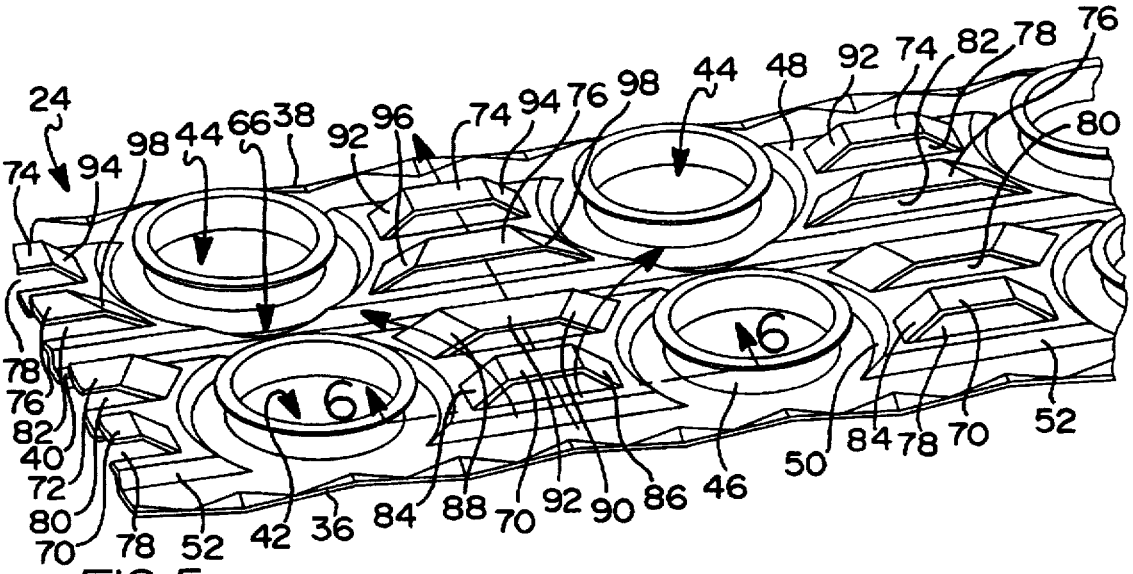
FIG 5
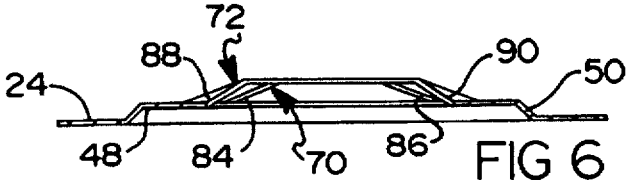
FIG 6

FIN TUBE HEAT EXCHANGER

BACKGROUND OF THE INVENTION

1. Field of the Invention

The present invention relates, generally, to a conductive fin for heat exchangers, such as condensers for automotive vehicles. More particularly, the present invention relates to a condenser having in-line, closely spaced tubes which are received in apertures of a plurality of elongated fin members disposed in regularly spaced intervals relative to one another.

2. Description of the Related Art

Fin and tube type heat exchangers are commonly used in vehicle, industrial and residential environments for heating and cooling purposes. In automotive environments, fin and tube type heat exchangers are often employed as condensers in conventional air conditioning systems which include an evaporator and compressor. A typical fin and tube type arrangement known in the related art is shown at 10 in FIG. 1. These heat exchangers 10 utilize a plurality of hairpin shaped tubes 12 to form a condenser or the like wherein the fluid passes through the plurality of tubes 12. The number of tubes 12 depends upon the thermal capacity requirements of the heat exchanger. Interleaved between the plurality of tubes 12 are a plurality of stacked fin members 14 which aid in dissipating the heat from the condenser as is well known in the art. A manifold (not shown) interconnects the tubes so that the fluid can flow therethrough.

In air conditioning systems, refrigerant enters the condenser as a super-heated vapor at high temperature and pressure. Heat is rejected in the condenser and the refrigerant leaves the condenser as a low temperature, high pressure liquid. The refrigerant then passes through an expansion throttle and enters the evaporator at a low temperature and low pressure as a vapor/liquid mixture. The refrigerant absorbs heat in the evaporator changing to a vapor at higher temperature and low pressure whereafter it is compressed in a compressor such that it is again a high temperature, high pressure, super-heater vapor at the inlet of the condenser. The cycle is then repeated.

The heat transfer on the air side of the condenser follows forced convection principles. Heat transfer via forced convection is a function of the Reynolds Number which is a dimensionless figure defined by the ratio of inertia to viscous forces in the velocity boundary layer of the fin. The Reynolds Number is a strong function of air flow. As the air flow across the tube and fins of the condenser increases, the Reynolds Number increases which increases the heat transfer from the condenser to the atmosphere. Generally speaking, at Reynolds Numbers below 2100, the air flow is laminar resulting in heavy boundary layers and reduced heat transfer characteristics. On the other hand, where the Reynolds Number is beyond 10,000, a turbulent flow pattern exists and the boundary layer is thin. As a general matter, heat transfer is better in this later condition. Thus, when turbulence is induced into the air flow over a condenser, better heat transfer is achieved, even at lower Reynolds Numbers.

However, this improved heat transfer does not come without a cost. An increase in heat transfer also increases pressure drop across the air side of the condenser. In automotive vehicles, the air conditioning condenser is often positioned adjacent the fan and upstream of the radiator in the forward portion of the engine compartment. One of the design objectives in this environment involves limiting the pressure drop across the condenser such that there is sufficient air flow across the radiator to maintain heat transfer efficiencies in the engine cooling system. Further, in automotive applications, space is always at a premium and therefore the size configuration or "packaging" of the condenser is an important consideration. However, reducing the packaging of the condenser can have an effect on the air flow, Reynolds Number, heat transfer and pressure drop across the condenser. Therefore, another important design objective for fin and tube type heat exchangers is to maximize the heat transfer within the constraints of air pressure drop across the condenser.

Heat exchangers known in the related art have attempted to balance these competing considerations by employing multiple rows of tubes 12 extending through the fins 14 disposed in an offset or staggered relationship with respect to one another as shown in FIG. 1. However, while staggering the tubes 12 in such condensers improves heat transfer, it also causes a relatively high pressure drop. Another problem inherent in such condensers involves low velocity regions or "dead zones" 16 immediately down stream of the tubes 12. The air in such low velocity regions is substantially stagnant or circulates in eddies without immediately flowing downstream. As a result, the velocity boundary layer increases in these areas which has a substantial negative effect on heat transfer and thus the air side efficiency of the condenser.

In conventional air fin design, louvers or lances 18 are added to the fins 14 for the purpose of breaking up the boundary layer as air flows over the fins 14 and thus increases the air side coefficient of heat transfer. Further, multiple louvers and lances have been employed in the related art to guide air flow into the low velocity regions in an attempt to induce turbulent flow therein.

Still, disadvantages exist. As mentioned above, in the case where the flow tubes 12 are staggered relative to each other as shown in FIG. 1, there is an increase in pressure drop across the condenser. On the other hand, where a single row of tubes is employed, the packaging issues are addressed in a narrower condenser and the pressure drop across the condenser decreases. However, a condenser having only a single row of tubes has less heat transfer capacity and therefore lower efficiency than condensers having multiple rows of tubes.

Thus, it would be advantageous to provide a heat exchanger such as a condenser for automotive vehicles which employs two rows of tubes so as to maximize heat transfer across the condenser within the constraints of acceptable pressure drop and packaging issues in the system and while inducing turbulent flow between the row of tubes.

SUMMARY OF THE INVENTION

Accordingly, the present invention is a conductive fin for a heat exchanger including an elongated fin member having a pair of longitudinally extending edges and a centerline extending between the edges and bisecting each of the fin member. The fin member has two rows of tube receiving apertures through the fin member which extend the length of the fin member on either side of the centerline so as to form a series of closely spaced pairs of apertures located in-line and substantially parallel to the flow of air across the heat exchanger.

Two rows of raised members extend the length of the fin member with one of the two rows of raised members located on either side of the centerline bisecting the fin member so as to form a series of closely spaced pairs located between any two tube receiving apertures in each of the rows of tube receiving apertures. Each one of the respective pairs of the raised members is arranged so as to be symmetrical about the centerline with respect to the other in the pair and offset relative to the plane of the fin member so as to define two openings adapted to accommodate the flow of air over the fin member and to reduce the velocity boundary layer. One of the two openings is smaller than the other and the larger of the two openings is located adjacent the centerline of the fin member.

Each of the raised members defines a pair of legs which extend from the plane of the fin member and are positioned to channel air flowing between the raised member and the tube receiving apertures into the space between each respective pair of apertures so as to increase the coefficient of heat transfer therebetween and thus increase the air side efficiency of the heat exchanger without increasing the air pressure drop across the heat exchanger.

One advantage of the present invention is that a conductive fin for a heat exchanger is provided which effectively maximizes heat transfer across the heat exchanger. Another advantage of the present invention is that the air pressure drop across the heat exchanger is reduced. Still another advantage of the present invention is that the improvements in the above-mentioned operating parameters are achieved in a heat exchanger which can function as a condenser in the air conditioning system of an automotive vehicle while minimizing the space required for the device and thus ameliorating packaging issues in the cooling system.

Other features and advantages of the present invention will be readily appreciated as the same becomes better understood after reading the subsequent description taken in conjunction with the accompanying drawings.

BRIEF DESCRIPTION OF THE DRAWINGS

FIG. 1 is a partial view of a fin tube heat exchanger of the related art.

FIG. 2 is a perspective view of a tube and fin heat exchanger, such as an automotive condenser.

FIG. 3 is a perspective view of a fin member of the present invention.

FIG. 4 is a cross-sectional view of the fin member of FIG. 4 taken through one of the raised members.

FIG. 5 is a perspective view of an alternate fin member of the present invention.

FIG. 6 is a cross-sectional view of a fin member of FIG. 5 taken through one of the raised members.

DESCRIPTION OF THE PREFERRED EMBODIMENT(S)

Referring now to the drawings, FIG. 2 shows a fin and tube type heat exchanger, such as a condenser 20 including a plurality of hair pin-shaped tubes 22 as well as a plurality of elongated heat dissipative fins 24 interposed between each of the tubes and at regularly spaced intervals relative to one another. The free ends of the hair pin tubes 22 engage a manifold 26 disposed at one end of the heat exchanger 20. The manifold 26 can be any of a number of known configurations of manifolds, such as that disclosed in U.S. Pat. No. 5,190,101, assigned to the assignee of the present invention. As shown in the '101 patent, the manifold is a double-chamber manifold having a first and second fluid conduit, including an inlet port 28 for receiving fluid therein and an outlet port 30 for discharge of fluid therefrom. As further explained in the '101 patent, the manifold includes a plurality of baffles for directing the fluid through the heat exchanger according to a predefined pathway. In accordance with principles well known in the heat exchanger art, fluid to be cooled (or heated) enters the manifold through the inlet port 28 and is directed through the plurality of hair pin-shaped tubes 22. The fluid is then cooled by the secondary fluid, such as air passing over the fins 24. The baffles in the manifold direct the fluid through the hair pin tubes wherein the fluid eventually discharges from the outlet port 30. It should be apparent to those skilled in the art that the heat exchanger in FIG. 2 can utilize a manifold having a single fluid conduit or a multiple fluid conduit.

The present invention will be described herein with reference to the condenser 20 of FIG. 2. However, it will become apparent to those skilled in the art that the present invention can be utilized with other fin and tube type heat exchangers, such as radiators and the like, which use straight tubes in parallel flow arrangement, not hair pin-shaped tubes, and fluid conduit assemblies, such as tanks in place of manifolds.

The condenser 20 further includes a pair of tube support members, such as end sheets 32, 34. One end sheet 32 is disposed adjacent the manifold 26 while the second end sheet 34 is disposed at an opposite end of the condenser from the manifold 26. Each of the end sheets 32, 34 supports the tubes 22 and can further be utilized as attachment means for attaching the condensers to the vehicle. The end sheets 32, 34, are generally U-shaped members, having a planer base portion and a pair of flanges extending perpendicularly therefrom. The end sheets 32, 34 include a plurality of tube-receiving apertures therein.

One embodiment of the fin member 24 of the present invention is illustrated in FIG. 3. Each of the fin members 24 is formed from thin, aluminum ribbon stock. Each of the fin members 24 has a pair of longitudinally extending edges 36, 38 and a centerline 40 extending between the edges 36, 38 and bisecting each of the fin members 24. Each of the fin members 24 also has two rows of tube receiving apertures 42, 44 extending the length of the fin members 24. One of the two rows is located on either side of the centerline 40 so as to form a series of closely spaced pairs of apertures 42, 44 located in-line and substantially parallel to the flow of air across the heat exchanger as indicated by the center arrow in FIG. 3.

Each of the tube receiving apertures 42, 44 includes circular collars 46 extending from the plane defined by the fin member 24. The heat exchanging tubes 22 are inserted through and fixedly secured to the tube receiving apertures 42, 44 via the collars 46 in each of the fin members 24.

The fin members 24 also include platform portions 48 bent from the plane of the fin members 24 and located between adjacent tube receiving apertures 42, 44 in each of the two rows of tube receiving apertures 42, 44. Each of the platform portions 48 includes arcuate flow surfaces 50 which are spaced from, but follow the contour of, the circular collars 46 to aid in channeling air between respective pairs of the tube receiving apertures 42, 44. The platform members 48 also include ramping surfaces 52 inclined relative to the plane of the fin members 24 and which extend in a direction parallel to the edges 36, 38 of the fin members 24. These inclined ramping surfaces 52 help to induce turbulent flow across the fin members 24. As shown in FIG. 3, the centerline is formed by a groove 40 which is created by the space between the platform members 48 on either side of the centerline 40.

The fin members 24 also include two rows of a plurality of raised members 54, 56 extending the length of each of the fin members 24. Each of the raised members 54, 56 is a discrete element. One of the two rows of raised members 54, 56 are located on either side of the centerline 40 bisecting the fin member 24 so as to form a series of closely spaced pairs 54, 56 located between any two pairs of tube receiving apertures 42, 44 when viewed in the direction of air flow as indicated by the center arrow in FIG. 3. Furthermore, each one of the respective pairs of raised members 54, 56 is arranged so as to be symmetrical about the centerline 40. In this arrangement, the raised members 54, 56 are spaced relative to one of the pair of edges 36, 38 of the fin members 24 and are disposed relatively close to the centerline 40.

Each of the discrete raised members 54, 56 are lances bent from the fin members 24 and extending from the platform portion 48. More specifically, each of the raised members 54, 56 is offset relative to the plane of the fin member 24 so as to define two openings 58, 60. These openings 58, 60 accommodate the flow of air over the fin member 24 and reduce the velocity boundary layer thereof. As viewed in FIGS. 3 and 4, it can be seen that one opening 58 of the two openings 58, 60 is smaller than the other opening 60 and that the larger opening 60 of the two openings 58, 60 is located adjacent the centerline 40 of the fin member 24.

Each of the raised members 54, 56 also defines a pair of legs 62, 64 which extend from the plane of the fin member 24. The legs 62, 64 are positioned so as to channel air flowing between the raised members 54, 56 and the tube receiving apertures 42, 44 into the space, generally indicated at 66, between each respective pair of apertures 42, 44 as illustrated by the curved arrows in FIG. 3. Thus, the raised members 54, 56 act to increase turbulence and therefore the coefficient of heat transfer between respective pairs of apertures 42, 44 and thus increase the air side efficiency of the heat exchanger without increasing the air pressure drop across the heat exchanger. Furthermore, because the heat exchanger includes two rows of heat exchanging tubes 22 which are disposed in-line and closely spaced relative to one another, the increase in the above-identified operating parameters are achieved in a heat exchanger having a small "package" and significant heat transfer capacity.

Referring now to FIGS. 5 and 6, where like numerals are used to designate like structure, another embodiment of the fin member 24 of the present invention is disclosed. As with the fin member of FIGS. 3 and 4, the fin member 24 shown in FIGS. 5 and 6 is formed from thin aluminum ribbon stock. The fin member 24 includes a series of raised members 70, 72 and 74, 76 located in pairs on both sides of the centerline 40 bisecting the fin members 24 and between adjacent pairs of tube receiving apertures 42, 44. Each pair of raised members 70, 72 is symmetrical about the centerline 40 with respect to the pair of raised members 74, 76 which are disposed on the opposite side of the centerline from each other. The raised members 70, 72, 74, 76 are lances bent from the fin members 24 and extending from the platform portion 48. More specifically, each of the pairs of raised members 70, 72, 74, 76 includes a first member 70, 74 offset relative to the plane of the fin member 24 which defines two openings 78 of equal size and location near one of the pair of edges 36, 38 of the fin member 24. In addition, second members 72, 76 are offset relative to the plane of the fin member 24 and define two openings 80, 82. One of the two openings 80 is smaller than the other of the two openings 82 and the larger of the two openings 82 is located adjacent the centerline 40 of the fin member 24.

Each of the raised members 70, 72 defines a pair of legs 84, 86 and 88, 90, respectively, which extend from the plane of the fin member 24 and are positioned so as to channel air flowing between the raised members 70, 72 and the tube receiving apertures 42, 44 disposed on either side thereof and into the space 66 between each respective pair of apertures. Similarly, raised members 74, 76 define legs 92, 94 and 96, 98 respectively. These legs 92, 94 and 96, 98 extend from the plane of the fin member 24 and are positioned to channel air flowing between the raised members 74, 76 and the tube receiving apertures 42, 44 disposed on either side thereof, into the space between each respective pair of apertures. This channelling of the air flow increases turbulence and therefore the coefficient of heat transfer in the space 66 between the in-line heat exchanging tubes 22 and thus increases the air side efficiency of the heat exchanger without increasing the air pressure drop across the heat exchanger.

In either one of the embodiments disclosed herein, the improvements in the above-mentioned operating parameters are achieved in a heat exchanger which can function as a condenser in the air conditioning system of an automotive vehicle while minimizing the space required for the device and thus ameliorating packaging issues in the cooling system.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A conductive fin for a heat exchanger comprising:

an elongated fin member having a pair of longitudinally extending edges and a centerline extending between said edges and bisecting said fin member;

said fin member having two rows of tube receiving apertures extending the length of said fin member with one of said two rows located on either side of said centerline so as to form a series of closely spaced pairs of apertures located in-line and substantially parallel to the flow of air across the heat exchanger;

said tube receiving apertures including circular collars extending from the plane defined by said fin member for engaging heat exchanging tubes, said fin members including platform portions bent from the plane of said fin member and located between adjacent tube receiving apertures in each of said two rows of tube receiving apertures, each of said platform portions including arcuate flow surfaces which are spaced from but follow the contour of said circular collars of said tube receiving apertures to aid in channeling air between respective pairs of said tube receiving apertures;

two rows of raised members extending the length of said fin member with one of said two rows of raised members located on either side of said centerline bisecting said fin member so as to form a series of closely spaced pairs located between any two tube receiving apertures in each of said rows of tube receiving apertures, each one of said respective pairs of said raised members arranged so as to be symmetrical about said centerline;

each of said raised members being offset relative to the plane of said fin member so as to define two openings adapted to accommodate the flow of air over said fin member and to reduce a velocity boundary layer thereof with one of said two openings being smaller than the other and the larger of said two openings located adjacent said centerline of said fin member; and each of said raised members defining a pair of legs extending from the plane of said fin member and positioned to channel air flowing between said raised member and said tube receiving aperture into the space between each respective pair of apertures so as to increase the coefficient of heat transfer therebetween.

2. A conductive fin for a heat exchanger as set forth in claim 1 wherein each of said raised members are spaced relative to one of said pair of edges of said fin member and disposed relatively close to said centerline of said fin member.

3. A conductive fin for a heat exchanger as set forth in claim 1 wherein said platform members include ramping surfaces inclined relative to the plane of said fin member and extending in a direction parallel to said edges of said fin member to induce turbulent flow across said fin member.

4. A conductive fin for a heat exchanger as set forth in claim 1 wherein said centerline is formed by a groove created by the space between said platform members on either side of said centerline.

5. A conductive fin for a heat exchanger as set forth in claim 1 wherein said raised members are lances bent from said fin member and extending from said platform portions.

6. A conductive fin for a heat exchanger as set forth in claim 1 wherein said fin member is formed from thin ribbon stock.

7. A conductive fin for a heat exchanger as set forth in claim 6 wherein said ribbon stock is made of aluminum.

8. A fin and tube type heat exchanger comprising:

a plurality of elongated fin members disposed in regularly spaced intervals relative to one another with each of said fin members having a pair of longitudinally extending edges and a centerline extending between said edges and bisecting each of said fin members;

each of said fin members having two rows of tube receiving apertures extending the length of said fin members with one of said two rows located on either side of said centerline so as to form a series of closely spaced pairs of apertures located in-line and substantially parallel to the flow of air across the heat exchanger;

a plurality of fluid carrying heat exchanging tubes inserted through and fixedly secured to said tube receiving apertures in said fin members;

said tube receiving apertures including circular collars extending from the plane defined by said fin member for engaging said heat exchanging tubes, said fin members including platform portions bent from the plane of said fin member and located between adjacent tube receiving apertures in each of said two rows of tube receiving apertures, each of said platform portions including arcuate flow surfaces which are spaced from but follow the contour of said circular collars of said tube receiving apertures to aid in channeling air between respective pairs of said tube receiving apertures;

two rows of raised members extending the length of each of said fin members with one of said two rows of raised members located on either side of said centerline bisecting said fin members so as to form a series of closely spaced pairs located between any two tube receiving apertures in each of said rows of tube receiving apertures, each one of said respective pairs of said raised members arranged so as to be symmetrical about said centerline;

each of said raised members being offset relative to the plane of said fin member so as to define two openings adapted to accommodate the flow of air over said fin members and to reduce a velocity boundary layer thereof with one of said two openings being smaller than the other and the larger of said two openings located adjacent said centerline of said fin members; and each of said raised members defining a pair of legs extending from the plane of said fin member and positioned to channel air flowing between said raised member and said tube receiving aperture into the space between each respective pair of apertures so as to increase the coefficient of heat transfer therebetween and thus increase the air side efficiency of the heat exchanger without increasing the air pressure drop across the heat exchanger.

9. A conductive fin for a heat exchanger comprising:

an elongated fin member having a pair of longitudinally extending edges and a centerline extending between said edges and bisecting said fin member;

said fin member having two rows of tube receiving apertures extending the length of said fin members with one of said two rows located on either side of said centerline so as to form a series of closely spaced pairs of apertures located in-line and substantially parallel to the flow of air across the heat exchanger;

said tube receiving apertures including circular collars extending from the plane defined by said fin member for engaging heat exchanging tubes, said fin members including platform portions bent from the plane of said fin member and located between adjacent tube receiving apertures in each of said two rows of tube receiving apertures, each of said platform portions including arcuate flow surfaces which are spaced from but follow the contour of said circular collars of said tube receiving apertures to aid in channeling air between respective pairs of said tube receiving apertures;

a series of raised members located in pairs on both sides of said centerline bisecting said fin member and between adjacent pairs of said tube receiving apertures with each pair of raised members being symmetrical about said centerline with respect to the pair of raised members disposed on the opposite side of said centerline; and each of said raised members defining a pair of legs extending from the plane of said fin member and positioned to channel air flowing between said raised member and said tube receiving aperture into the space between each respective pair of apertures so as to increase the coefficient of heat transfer therebetween.

10. A conductive fin for a heat exchanger as set forth in claim 9 wherein each of said pairs of raised members includes a first member offset relative to the plane of said fin member so as to define two openings of equal size and located near one of said pair of edges of said fin member and a second member offset relative to the plane of said fin member so as to define two openings with one of said two openings being smaller than the other and the larger of said two openings located adjacent said centerline of said fin member.

11. A conductive fin for a heat exchanger as set forth in claim 9 wherein said platform members include ramping surfaces inclined relative to the plane of said fin member and extending in a direction parallel to said edges of said fin member to induce turbulent flow across said fin member.

12. A conductive fin for a heat exchanger as set forth in claim 9 wherein said centerline is formed by a groove created by the space between said platform members on either side of said centerline.

13. A conductive fin for a heat exchanger as set forth in claim 9 wherein said raised members are lances bent from said fin members and extending from said platform portions.

14. A conductive fin for a heat exchanger as set forth in claim 9 wherein said fin members are formed from thin ribbon stock.

15. A conductive fin for a heat exchanger as set forth in claim 14 wherein said ribbon stock is made of aluminum.

* * * * *